US007887167B2

(12) United States Patent
Comas et al.

(10) Patent No.: US 7,887,167 B2
(45) Date of Patent: Feb. 15, 2011

(54) INKJET PRINTING APPARATUS WITH A PRIMING DEVICE

(75) Inventors: Esteve Comas, Sant Quirze Del Valles (ES); Jose Gabriel Escabia, Sant Quirze Valles (ES); Miquel Boleda, Sant Cugat (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 984 days.

(21) Appl. No.: 11/783,204

(22) Filed: Apr. 6, 2007

(65) Prior Publication Data

US 2008/0246823 A1 Oct. 9, 2008

(51) Int. Cl.
*B41J 2/175* (2006.01)

(52) U.S. Cl. ..... 347/85

(58) Field of Classification Search ..... 347/5, 347/7, 84, 85

See application file for complete search history.

(56) References Cited

U.S. PATENT DOCUMENTS

| | | | | |
|---|---|---|---|---|
| 5,975,689 | A * | 11/1999 | Pawlowski et al. | 347/86 |
| 6,203,146 | B1 * | 3/2001 | Pawlowksi et al. | 347/85 |
| 6,290,343 | B1 * | 9/2001 | Lewis et al. | 347/85 |
| 7,111,917 | B2 * | 9/2006 | Hill et al. | 347/7 |
| 7,484,837 | B2 * | 2/2009 | Koga et al. | 347/85 |
| 7,556,365 | B2 * | 7/2009 | Stathem | 347/86 |

* cited by examiner

*Primary Examiner*—Anh T. N. Vo

(57) ABSTRACT

An inkjet printing apparatus comprises at least one printhead which comprises at least one ink chamber and a plurality of nozzles, at least one ink container remote from the printhead, an ink delivery system comprising a source of gas under pressure operable to supply ink from said remote ink container to said ink chamber on the printhead, a priming device arranged to prime at least one printhead and comprising a connecting assembly to connect the source of gas under pressure to the printhead to be primed, and a controller to control the flow of gas through said connecting assembly to provide upon demand gas under pressure to the printhead in order to cause a flow of ink from the ink chamber through the nozzles to prime the printhead.

20 Claims, 7 Drawing Sheets

INKJET PRINTING APPARATUS WITH A PRIMING DEVICE

FIELD OF THE INVENTION

The present invention relates to an inkjet printing apparatus with a priming device.

BACKGROUND OF THE INVENTION

A printhead of an inkjet printing apparatus comprises a plurality of nozzles from which drops of ink are fired on a print media. Sometimes it is necessary to prime one or more printheads by varying a pressure differential to force ink to flow from an ink chamber within the printhead into the nozzles, in order to solve or alleviate problems that may be caused for example by the presence in the nozzles or in its associated firing chamber of dry or crusting ink, air bubbles or foreign particles, or by pigment ink settling.

The pressure differential needed for priming may be varied either by providing a suction effect though a cap sealingly applied around the nozzles on the outer part of the printhead or by increasing the pressure of the ink inside the printhead.

In printers provided with a relatively large ink container arranged remote from the printhead and a relatively small ink chamber within the printhead, in which the ink chamber is continuously fed from the remote container through a supply line, it is known e.g. from U.S. Pat. No. 4,558,326 to provide a positive pressure to the ink in the container in order to purge bubbles and ink contained in the printhead by ejecting ink through the nozzles.

Another known priming method, disclosed in commonly owned U.S. Pat. No. 6,419,343, involves applying a positive pressure to the ink in the ink chamber of the printhead by means of an air pump: the pump is operated by the travel of the printhead carriage to deliver a predetermined volume of gas to the ink chamber.

The predetermined piston stroke and cylinder volume of the pump operated by the travel of the printhead carriage limit the flexibility of the priming operation in terms of pressure and number of printheads primed. Furthermore, each different printing apparatus may require different pressures and thus a different geometry of the pump.

Since the pump is operated by the travel of the carriage, the system also requires a relevant carriage stroke to obtain enough pressure, and this makes it difficult to position the printhead to be primed in relation to the spittoon.

SUMMARY OF THE INVENTION

The present invention provides a printing apparatus with improved flexibility and throughput.

A printing apparatus comprises at least one printhead which comprises at least one ink chamber and a plurality of nozzles, at least one ink container remote from the printhead, an ink delivery system comprising a source of gas under pressure operable to supply ink from said remote ink container to said ink chamber on the printhead, a priming device arranged to prime at least one printhead and comprising a connecting assembly to connect the source of gas under pressure to the printhead to be primed, and a controller to control the flow of gas through said connecting assembly to provide upon demand gas under pressure to the printhead in order to cause a flow of ink from the ink chamber through the nozzles to prime the printhead.

Embodiments of the invention offer a number of advantages.

The use of the source of gas under pressure already employed in the ink delivery system allows a speedy priming operation, thus minimizing down time, because it doesn't need time to pressurize; it allows to set different priming pressure and other parameters with simple control elements; by the connection of the gas pressure to the printhead a desired amount of ink may be ejected in the priming operation; and at the same time the cost of the system is relatively low.

BRIEF DESCRIPTION OF THE DRAWINGS

Embodiments of the present invention will be described in the following, only by way of non-limiting example, with reference to the appended drawings, in which.

It has to be pointed out that for the sake of clarity most of the appended drawings are purely schematic, such that the relative positioning and the proportions between different elements may not be faithful.

DETAILED DESCRIPTION OF THE INVENTION

Figure 1:
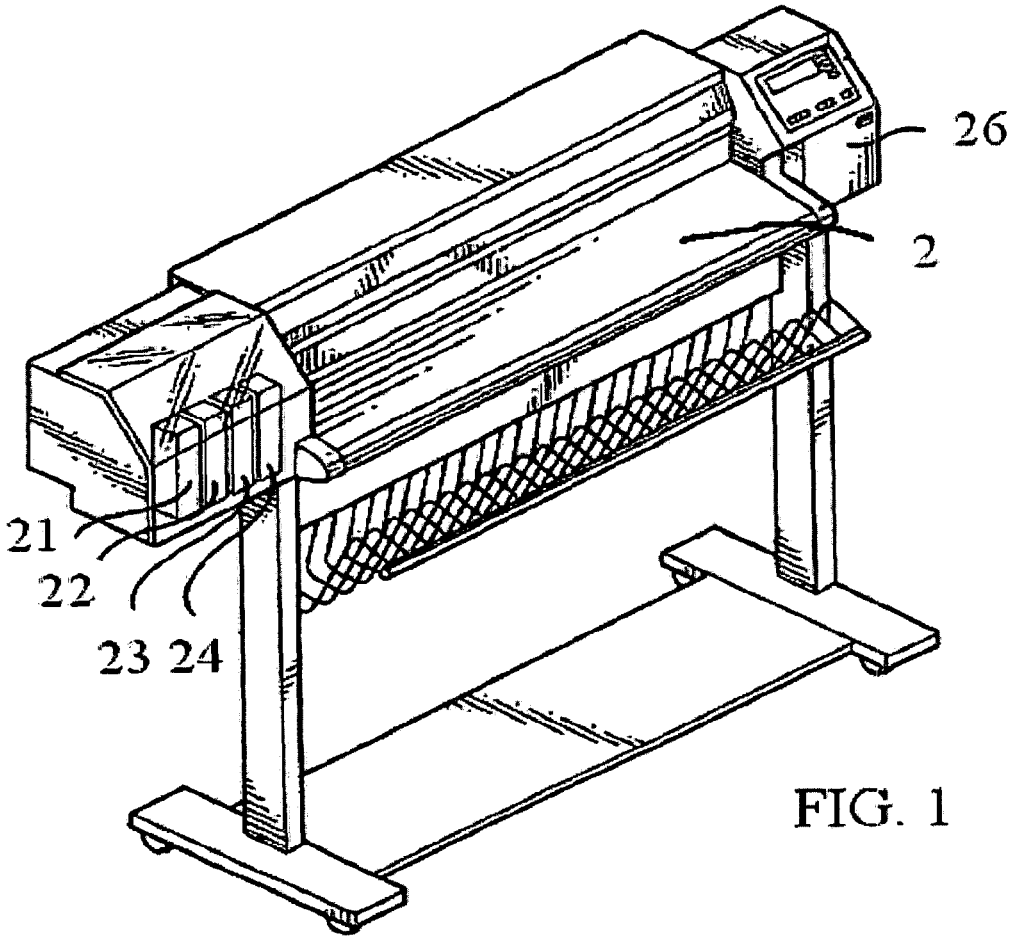
FIG. 1 is a schematic perspective view of an inkjet printer in which the present invention may be useful.
Figure 2:
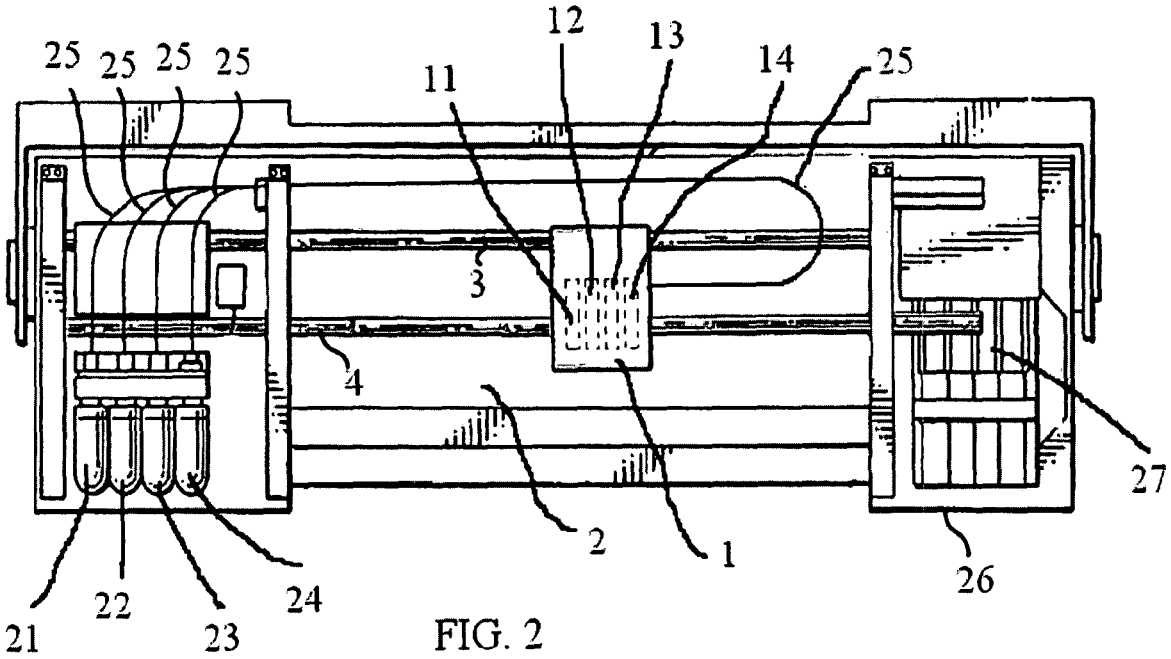
FIG. 2 is a schematic top plan view of the printer with its cover removed to show the printhead carriage, the ink cartridges and the service area where a priming device may be arranged.

FIGS. 1 and 2 show a large format inkjet printer of the type including a printhead carriage 1 which can reciprocate over a print platen 2 along transversely extending slider rods or guides 3 and 4. In this example, on the carriage 1 are mounted four inkjet printheads 11,12,13,14, respectively for printing with cyan, magenta, yellow and black ink.

However, it has to be pointed out that other embodiments are possible, such as eight printheads each containing inks of two different colours, arranged staggered on the carriage.

In FIG. 2, at the left side of the platen 2 there are four removable ink cartridges 21,22,23,24, each supplying ink to a corresponding inkjet printhead 11,12,13,14 through flexible conduits 25. The ink cartridges are remote from the printheads, since they are arranged stationary on the printer frame while the printheads reciprocate with the carriage.

On the right side of the printer there is a printhead service area 26, at which the carriage 1 may be parked for cleaning and priming the printheads. The service area 26 includes spittoons 27 to capture ink discharged by the printheads during servicing.

Figure 3:
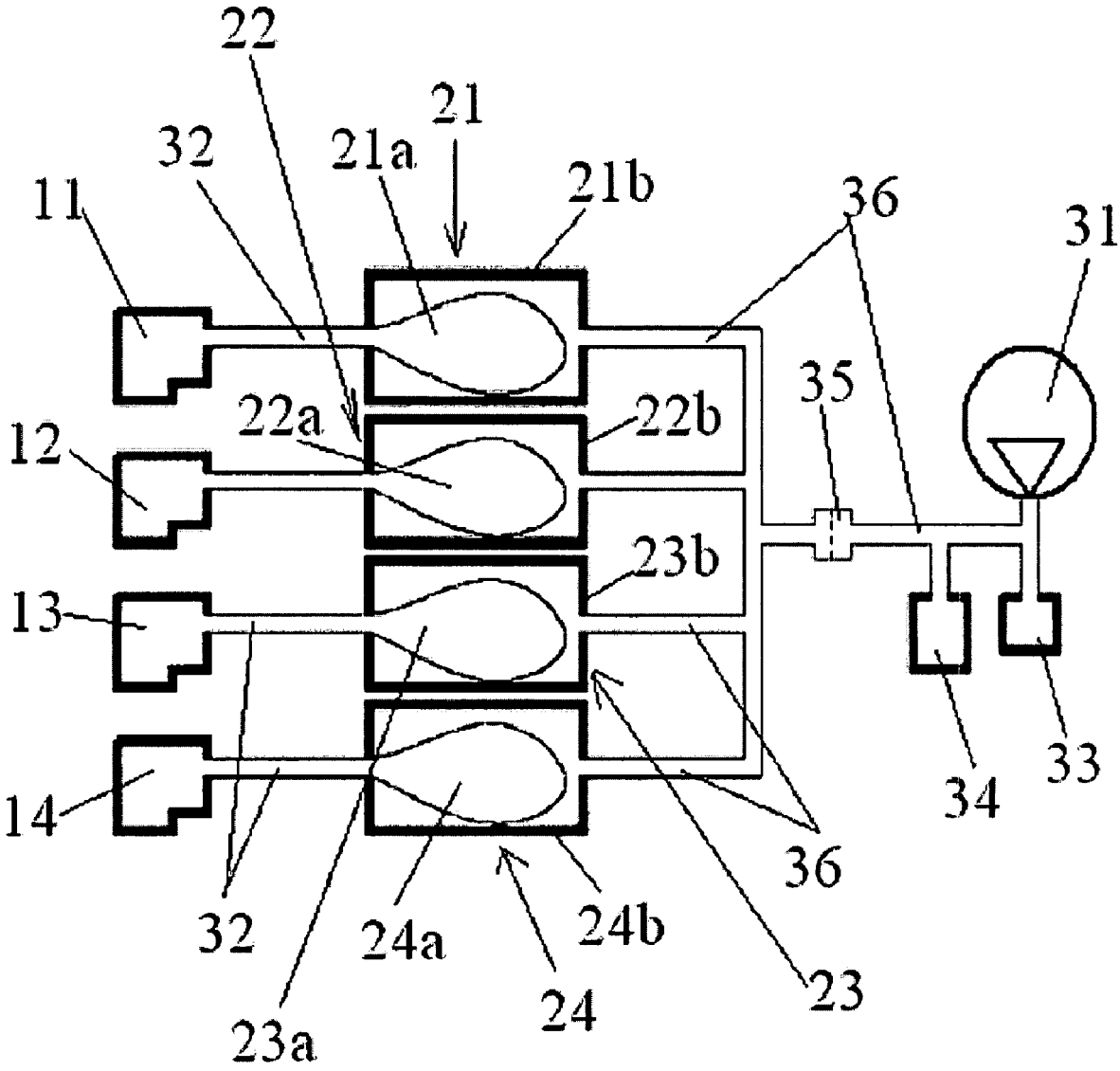
FIG. 3 shows very schematically the main elements of an ink delivery system.

FIG. 3 shows an embodiment of an ink delivery system 30 for delivering ink from the ink cartridges to the printheads.

Each cartridge includes a flexible ink container 21*a*, 22*a*, 23*a*, 24*a* encased within an outer shell 21*b*, 22*b*, 23*b*, 24*b*.

The ink containers are in fluid communication through ink supply conduits 32 with the corresponding printheads 11,12, 13,14.

The ink delivery system 30 further comprises an air pressure station, with a source of gas under pressure 31, such as a pump, a compressor, a pressurized gas tank or a combination thereof, whose outlet is connected through gas supply conduits 36 to the shells 21*b*, 22*b*, 23*b*, 24*b* of the ink cartridges. The system may also comprise a pressure sensor 33, a pressure relief valve 34, and/or a quick coupling 35, as well as check and/or control valves (not shown).

When gas under pressure is fed to the shells 21*b*, 22*b*, 23*b*, 24*b* through gas conduits 36, the flexible containers 21*a*, 22*a*, 23*a*, 24*a* are compressed and ink is delivered to the printheads through ink conduits 32.

Figure 4:
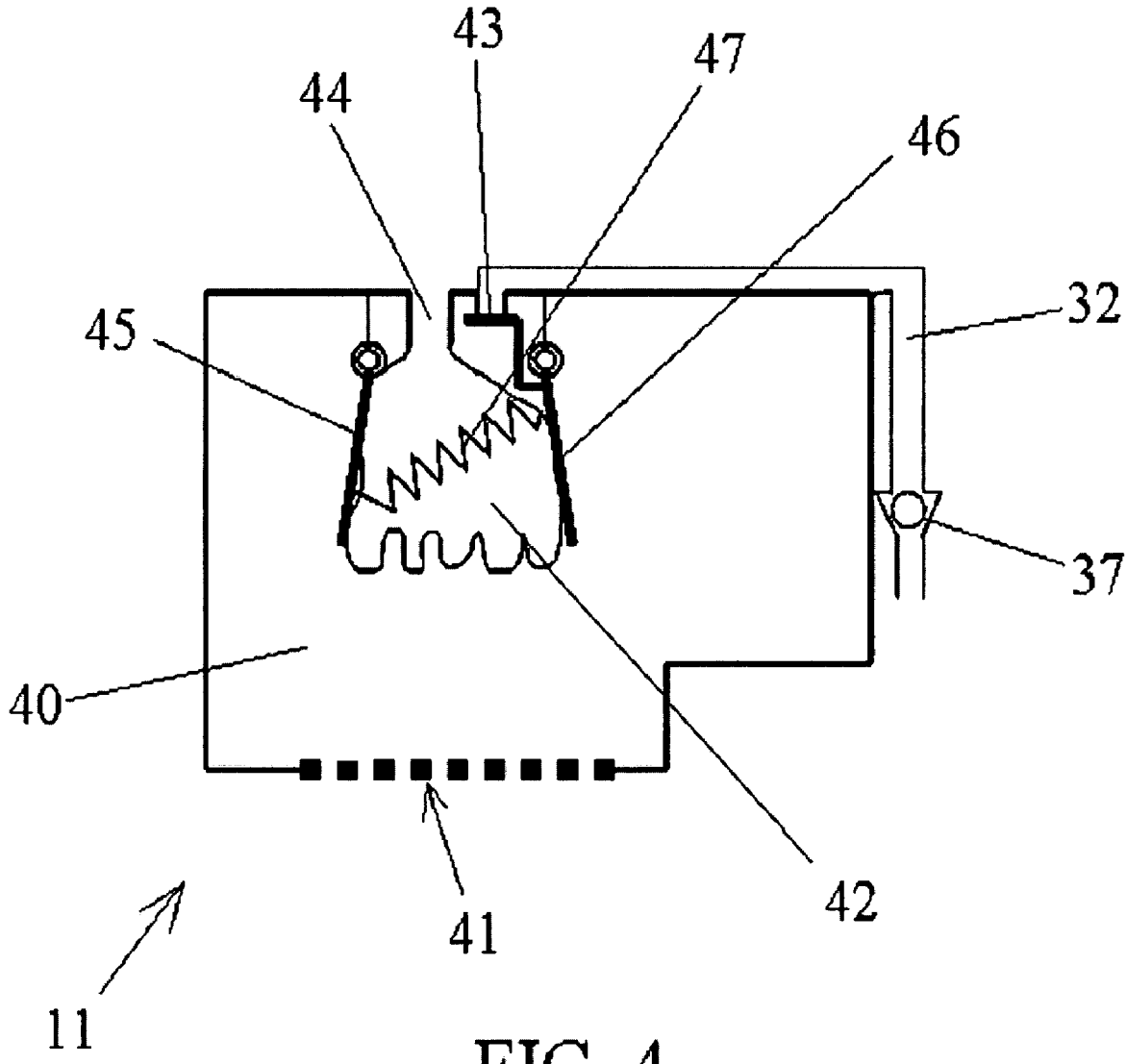
FIG. 4 is a simplified cross section across one of the printheads.

Each of the printheads in the embodiment of FIG. 3 may be as schematically shown in FIG. 4 for printhead 11: it comprises an ink chamber 40, a plurality of nozzles 41 from which ink drops are fired during printing, and a variable volume air chamber 42 which can expand within the ink chamber 40.

The ink chamber has an ink inlet 43 connected to ink conduit 32 in which a check valve 37 may be foreseen, while the variable volume air chamber 42 is connected to the ambient atmospheric pressure through a vent hole 44 with a labyrinth path (not shown), such that the air chamber is maintained at a reference pressure during normal printing.

The air chamber 42 is flanked by two levers 45 and 47, such that when it expands it causes pivoting of said levers; lever 47 is arranged such that its pivoting movement opens and closes ink inlet 43. A spring 46 is arranged asymmetrically between the two levers urging them against the ink chamber; due to the asymmetry of the spring, the first part of the expansion of the ink chamber 42 only causes pivoting of lever 45, while lever 47 starts pivoting and opens the ink inlet 43 only when the air chamber 42 reaches a certain volume. A similar printhead structure is disclosed in U.S. Pat. No. 6,419,343, to which reference can be made for any further details.

In the alternative embodiment mentioned above, a printhead may be built with two separate ink chambers, each with an inlet connected to an ink container and with an associated set of nozzles, and each with a variable volume air chamber with a vent hole.

Figure 5:
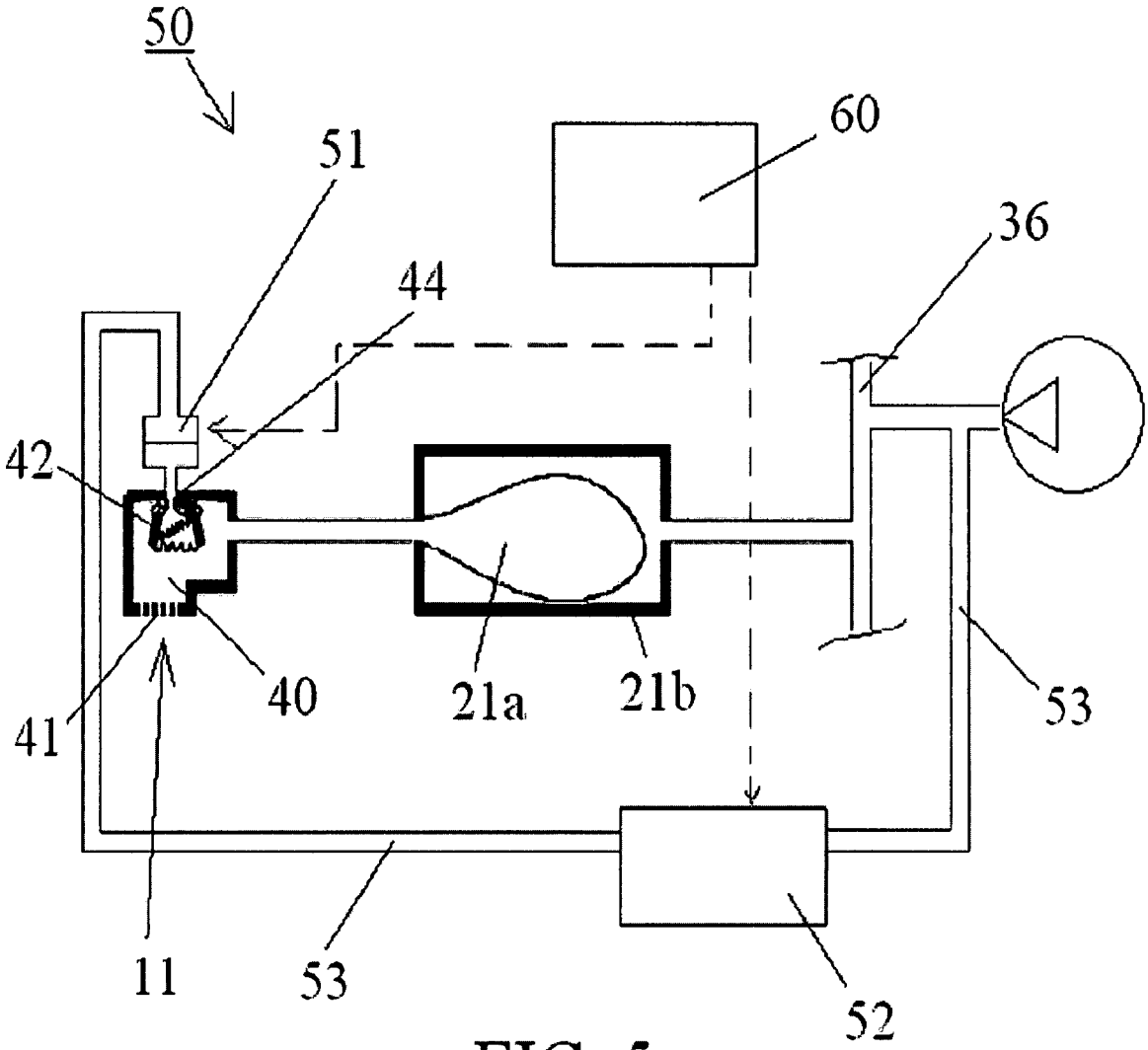
FIG. 5 is a diagram of a priming device according to embodiments of the invention, applied to a printer with a printhead such as that of FIG. 4.

A priming device 50 for priming the printheads may comprise, as shown in the diagram of FIG. 5 (where only one printhead 11 to be primed and its associated ink container 21*a* are shown), a coupling member 51 which can sealingly engage the vent hole 44 of the printhead, and a connecting assembly 52 including conduits 53, to connect the pump 31 to the printhead 11 via the coupling member 51.

A controller 60 is provided to control the priming operation, including the connection of the coupling member 51 to the vent hole 44 and the flow of gas through the connecting assembly 52 whereby the gas under pressure flows to the air chamber 42 increasing its volume and forcing ink from the ink chamber 40 through the nozzles 41.

The pressure sensor 33 present in the ink delivery system allows controlling also the gas pressure applied in the priming operation.

With reference to FIG. 5, in a method for priming a printhead 11 according to an embodiment of the invention, the priming device 50 is connected, for example through the connecting assembly 52, 53 and the coupling member 51, to the source of gas under pressure 31 associated to the ink delivery system of the printing apparatus, and gas under pressure is caused to flow from said source of gas under pressure to the variable volume air chamber 42 of the printhead; as a result the air chamber expands inside the ink chamber 40 of the printhead, and causes a flow of ink through the nozzles.

Figure 6A:
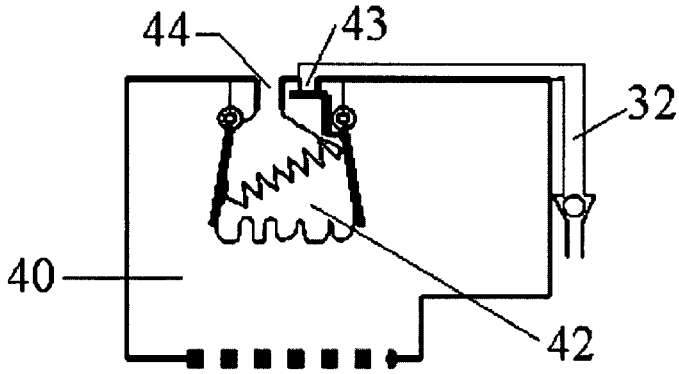
FIGS. 6*a* to 6*d* show several steps of an embodiment of a priming operation.

In embodiments of the method, the process in the printhead is as shown in FIGS. 6*a* to 6*d*. FIG. 6*a* shows a printhead before the priming operation starts, with the air chamber 42 in collapsed condition and the ink inlet 43 closed.

Figure 6B:
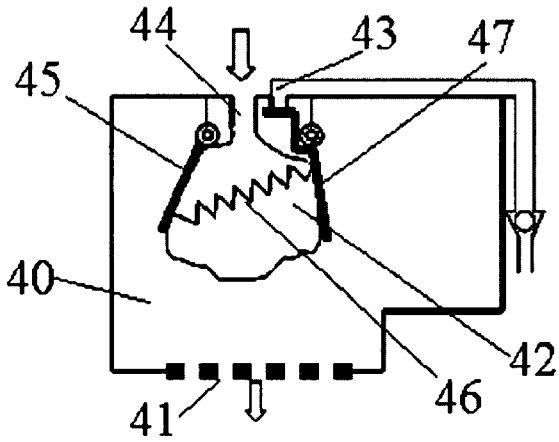

When the vent hole 44 is put in communication with the source of gas under pressure, gas enters the air chamber 42, which starts to inflate and causes pivoting of lever 45 (FIG. 6*b*). The increase in volume of air chamber 42 forces an ink flow from ink chamber 40 through the nozzles 41.

Figure 6C:
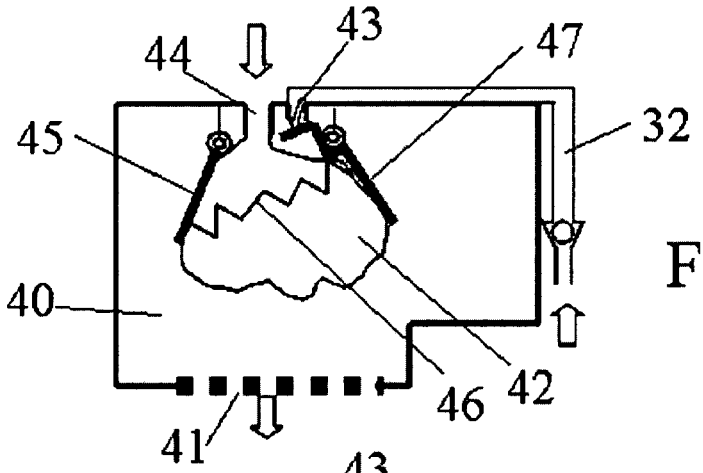
Figure 6D:
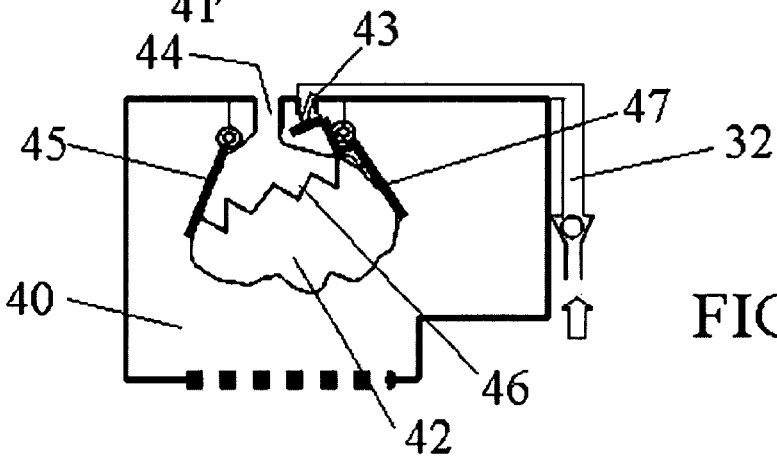

When the air chamber 42 reaches a certain volume, as shown in FIG. 6*c*, lever 47 also starts pivoting and opens the ink inlet 43, whereby ink from the supply conduit 32 may be delivered to the ink chamber 40; during this initial ink delivery step the ink flow through the nozzles 41 may continue. Depending on the features of each particular case, it is also possible that no ink or little ink enters the ink chamber 40 in this step, for example depending on the pressure used for priming and the pressure in the ink delivery system.

Once the priming device is disconnected from the vent hole 44 (FIG. 6*d*) to end the priming operation, the air chamber 42 starts deflating slowly through the labyrinth passage of the vent hole, under the pressure exerted by the spring 46 and levers 45 and 47; delivery of ink to the ink chamber 40 continues until the air chamber 42 has deflated down to a certain volume and lever 47 closes the ink inlet 43 again.

In the described priming device and method there is a physical relationship between priming and ink feeding, such that the possibility of priming while the ink supply has no pressure (with the risk of entraining air bubbles) in minimized.

In embodiments of the invention, the priming pressure and/or the priming position can be selected as desired.

Embodiments of the invention have another advantage with respect to priming systems using a carriage-driven pump such as that of U.S. Pat. No. 6,419,343. In case of an air leakage, the pump of U.S. Pat. No. 6,419,343 could exert a negative pressure on the air chamber when the carriage withdraws from the pump piston, and this negative pressure could in turn cause the suction of air into the ink chamber. This risk is avoided with a priming system such as described above, since even in case of an air leakage no negative pressure would be induced in the air chamber.

Figure 7:
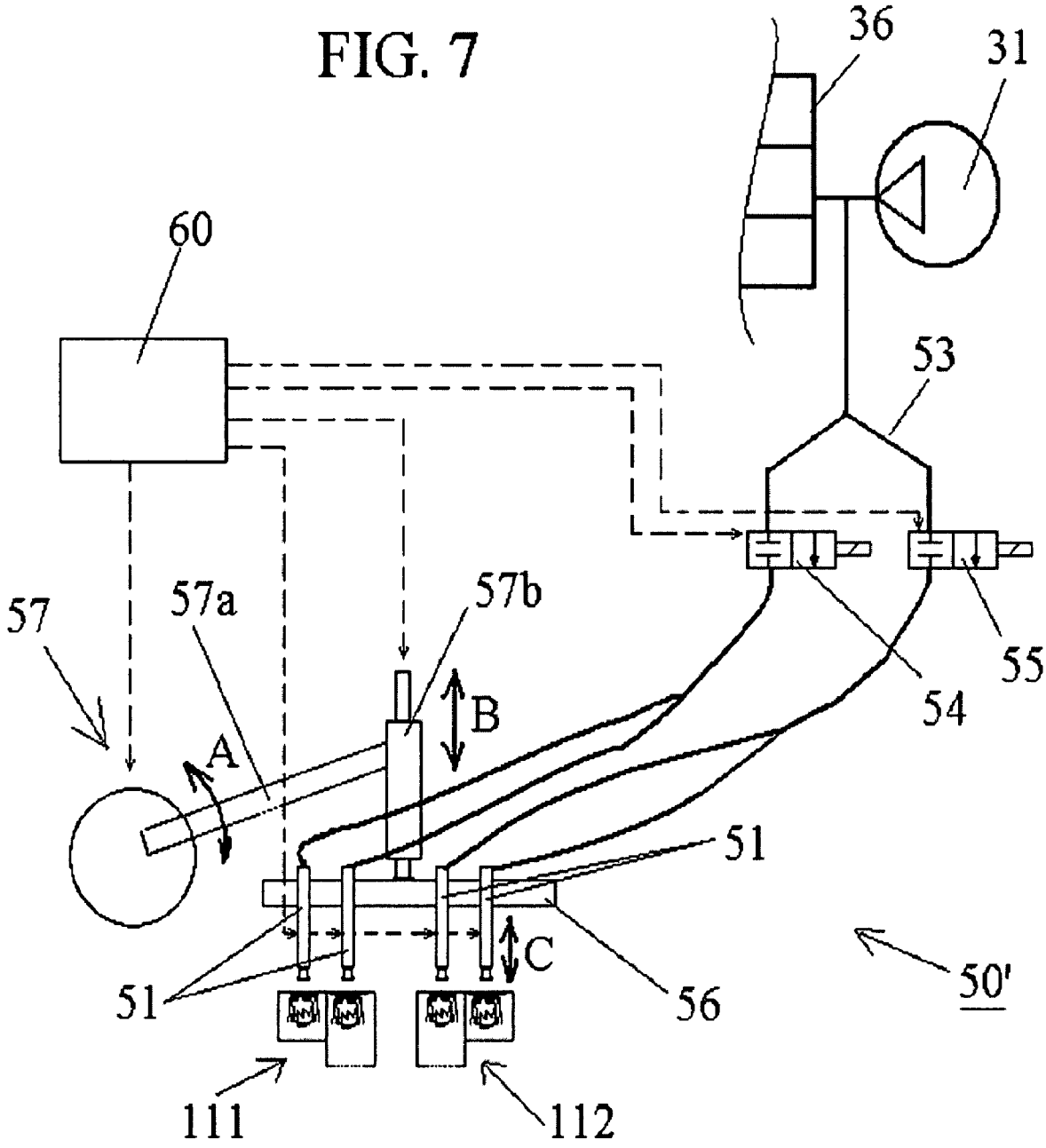
FIG. 7 shows another embodiment of the priming device, applied to two printheads each having two ink chambers for two colours of ink.

FIG. 7 shows a priming device 50' according to another embodiment of the invention.

In the figure the priming device is shown applied to two printheads 111, 112, each having two ink chambers as described above and indicated as 140 and 140' (FIG. 8), each connected to one of the remote ink containers; within each ink chamber there is a variable volume air chamber 142, 142', such as a flexible bag, with corresponding vent holes 144, 144'. Each ink chamber 142, 142' is connected to a corresponding set of nozzles 41. Elements similar to those of FIG. 5 maintain the same reference numerals in FIG. 7.

The connecting assembly 52 of the priming device 50' comprises in FIG. 7 two air conduits 53 branching from the ink delivery system 30, with a solenoid valve 54, 55 in each conduit. Downstream of the valves each of the conduits is further divided in two branches.

Four coupling members 51 are shown arranged on a common support 56 in relative positions such that each of them can engage one of the vent holes of the printheads.

The priming device 50' comprises a positioning unit 57, which operates to selectively position the support 56 and the coupling members 51 in a priming position (FIG. 7) in which at least one of the coupling member 51 engages a vent hole of an air chamber of a printhead, and an inactive position (not shown) in which the coupling members are disengaged from the vent holes.

In some embodiments, all the coupling members 51 mounted on the common support 56 are simultaneously engaged to the vent holes (in the figure, the chambers 144, 144' of the two printheads 112 are shown engaged with coupling members 51); however, this doesn't mean all the ink chambers or printheads must be primed, as will be explained below.

The positioning unit 57 may comprise an arm 57*a* mounted on the printing apparatus (in the service area 26 shown in FIG. 2) and carrying said common support 56.

In this example the positioning unit 57 has two degrees of freedom: the arm 57*a* pivots around a horizontal axis for a fast approximation movement of the support 56 towards the printheads (arrow A), and the support 56 is mounted with a further degree of freedom on the arm 57*a*, here a movement by a linear actuator 57*b*, whereby the support 56 can be lowered or raised towards or away from the printheads (arrow B).

Figure 8:
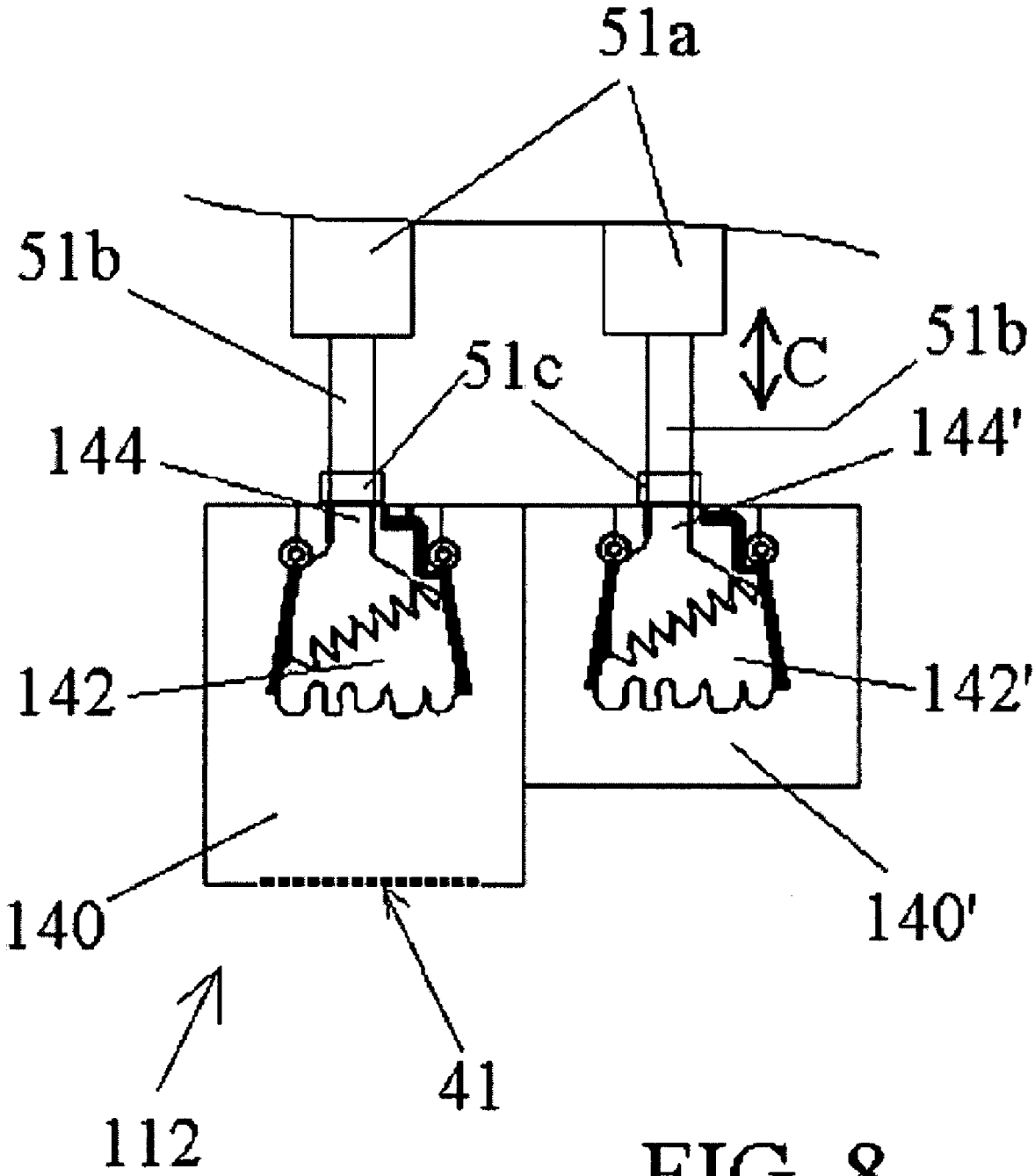
FIG. 8 is an enlarged view of a detail of FIG. 6.

Once the support 56 is in a close-up position on the printheads as shown in FIG. 7, the coupling members 51 may be brought into engagement with the vent holes 144, 144', as best seen in FIG. 8.

In FIG. 8, each coupling member 51 has a tubular housing 51*a* which is fixed to the common support 56 and an inner tube 51*b* which can slide within said housing 51*a* (arrow C), driven by actuators of the positioning unit 57, between a retracted position (coupling members 51 positioned above the printheads in FIG. 7) and an extended position (coupling members 51 in FIG. 8). Each inner tube has a seal 51*c* attached at its free end, such that in the extended position it is sealingly engaged with a vent hole 144, 144'.

The priming device of FIGS. 7 and 8 operates as follows.

During normal printing, valves 54 and 55 are in closed position, as depicted in FIG. 7, and the air chambers 142, 142' of the printheads are in communication with the ambient air through vent holes 144, 144'.

When at least one printhead 112 has to be primed, the carriage 1 is brought to a position in the service station 26 in which at least the printhead 112 is arranged in front of the positioning unit 57 and support 56, and over a spittoon 27 (FIG. 2).

The positioning unit 57 then positions the support 56 at a short distance above the printhead 112, first by a rotation (arrow A) of the arm 57*a* and then by a linear movement (arrow B) of the linear actuator 57*b*.

The inner tubes 51*b* of the coupling members 51 which are arranged opposite the vent holes 144, 144' of the printhead 112 are then lowered (arrow C) until they are in sealing engagement with the vent holes. The same may happen with the coupling members 51 corresponding to printhead 111 (not shown in FIG. 8).

Once this priming position is reached, solenoid valve 55 is operated such as to open fluid communication between the pump 31 and the variable volume air chambers 142, 142', through conduits 53 and coupling members 51.

This causes an increase of pressure in air chambers 142, 142' and their consequent expansion, which forces a flow ink from ink chambers 140, 140' through the nozzles of the printhead 112.

Since only valve 55 is operated according to this embodiment, the chambers of printhead 111 will not be primed in spite of being in engagement with coupling members 51, because valve 54 remains in closed position and therefore no gas pressure will be provided to printhead 111.

The controller 60 controls the operation of the different units of the priming device.

In this embodiment of the method, by priming the two ink chambers 140 and 140' of a printhead at the same time, the possibility that the nozzles of one of the chambers are soiled with ink from the nozzles of the adjacent chamber is avoided.

It would also possible to prime only one chamber, and since the gas under pressure comes from a continuous source and not a limited volume, it is also possible to prime at the same time more printheads, for example two (thus four chambers, in this embodiment), by setting the controller 60 accordingly and opening both valves 54 and 55.

With different designs of the positioning unit 57 and support 56 further arrangements are possible; and of course the design may be altered depending on the number and the features of the printheads to be primed.

In the embodiment shown in FIG. 7, the gas pressure used for priming will be equal to the pressure employed in the ink delivery system during printing; however, if convenient a different pressure may be used by adding appropriate pressure regulating elements in the connecting assembly.

For example, the gas pressure may be lowered before priming by opening the relief valve 34 (FIG. 3) until the pressure sensor 33 detects an appropriate pressure level, in order to avoid a risk of damaging the flexible air chamber 42 during priming.

For example, in some printing apparatus the pressure in the source of gas under pressure may be between 100 and 120 inches of water, while an appropriate priming pressure may be around 80 inches of water. In this case, the process for priming a printhead involves opening the relief valve to lower the gas pressure in the gas source to 80 inches; then the gas source is put in communication with an air chamber of a printhead, and the pressure in the air chamber increases to 80 inches (priming operation). Then the air chamber is opened again to the atmosphere, such that its pressure decreases, while the pressure in the gas source is raised again to its normal level.

In other embodiments, a check valve may be inserted in the connecting assembly 52 of the priming device, for example immediately downstream the source of gas under pressure 31, such that before priming it is possible to increase the pressure in the priming system above the pressure level used to deliver ink to the ink chamber, and this higher pressure can be used for priming without affecting the ink delivery system. In this case, at least part of the conduits 53 downstream, the check valve can be dimensioned appropriately to be used as an accumulator for the priming operation.

In further embodiments, if a solenoid valve is employed instead of a check valve, the priming pressure can be made higher or lower than the pressure used to deliver ink to the ink chamber, at will.

When valves such as 54, 55 are employed in the priming device, it is possible to use at least one of said valves as a pressure relief valve (when the system is not in priming position), and therefore a relief valve in the air pressure station of the ink delivery system would be redundant and could be avoided.

The invention claimed is:

1. An inkjet printing apparatus comprising:

at least one printhead comprising at least one ink chamber and a plurality of nozzles, at least one ink container remote from the printhead, an ink delivery system comprising a source of gas under pressure operable to supply ink from said remote ink container to said ink chamber on the printhead, a priming device arranged to prime at least one printhead and comprising a connecting assembly to connect the source of gas under pressure to the printhead to be primed, and a controller to control the flow of gas through said connecting assembly to provide upon demand gas under pressure to the printhead in order to cause a flow of ink from the ink chamber through the nozzles to prime the printhead, wherein the priming device comprises at least one coupling member and a positioning unit operable to selectively position the coupling member in a priming position in which the coupling member engages a vent hole of an air chamber of the printhead, and an inactive position in which the coupling member is disengaged from the vent hole, whereby, in the priming position, the coupling member provides fluid communication between the source of gas under pressure and the air chamber of the printhead.

2. An apparatus as claimed in claim 1, wherein the air chamber comprises at least one variable volume air chamber which can expand inside the ink chamber, said air chamber being connected to ambient atmospheric pressure through the vent hole in the printhead, and said coupling member appropriate to sealingly engage the vent hole of the air chamber.

3. An apparatus as claimed in claim 2, wherein the connecting assembly of the priming device comprises at least one air conduit extending between the source of gas under pressure and said at least one coupling member.

4. An apparatus as claimed in claim 3, wherein the priming device comprises a positioning unit operable to selectively position said coupling member in and out of engagement with said vent hole.

5. An apparatus as claimed in claim 3, wherein the connecting assembly of the priming device comprises at least one control valve operable to selectively open or close the flow of gas through the air conduit.

6. An apparatus as claimed in claim 3, wherein the priming device comprises at least two coupling members arranged on a common support and the positioning unit operable to selectively position the common support and the coupling members in a priming position in which at least one coupling member engages a vent hole of an air chamber of a printhead, and an inactive position in which the coupling members are disengaged from the vent holes.

7. An apparatus as claimed in claim 6, wherein said positioning unit comprises an arm pivotably mounted on the printing apparatus and carrying said common support.

8. An apparatus as claimed in claim 7, wherein said common support is mounted with a degree of freedom on the distal end of said arm.

9. An apparatus as claimed in claim 8, wherein said degree of freedom is a linear movement.

10. An apparatus as claimed in claim 6, wherein each coupling member comprises a tubular housing fixed to the common support and an inner tube which can slide within said housing between a retracted position and an extended position, said inner tube having a seal attached at one of its ends and adapted to sealingly engage a vent hole of an air chamber of a printhead.

11. An apparatus as claimed in claim 1, wherein said at least one printhead is arranged on a carriage and the apparatus further comprises a service area in which is arranged at least part of said priming device, the carriage being adapted to position a printhead to be primed in correspondence with the priming device in the service area.

12. An apparatus as claimed in claim 11, wherein the service area comprises a spittoon arranged such that when a printhead is positioned in the service area in correspondence with the priming device the nozzles of the printhead are facing the spittoon.

13. An apparatus as claimed in claim 1, wherein the pressure of the gas provided to the printhead through said connecting assembly is equal to the pressure of the gas in the ink delivery system.

14. An apparatus as claimed in claim 1, wherein said connecting assembly is provided with at least one pressure regulating member.

15. An apparatus as claimed in claim 1, wherein the priming device is arranged to prime at least two printheads simultaneously.

16. A priming device for priming at least one printhead of an inkjet printing apparatus, comprising:

at least one coupling member adapted to sealingly engage a vent hole of a variable volume air chamber of a printhead, a connecting assembly for connecting said coupling member to a source of gas under pressure associated to an ink delivery system of the printing apparatus, and a positioning unit operable to selectively position said coupling member in a priming position in which said coupling member engages said vent hole, and an inactive position in which said coupling member is out of engagement with said vent hole, wherein, in said priming position, said coupling member provides fluid communication between the source of gas under pressure and the air chamber of the printhead.

17. An inkjet printing apparatus comprising a priming device as claimed in claim 16.

18. A method for priming a printhead of an inkjet printing apparatus by causing a flow of ink through a plurality of nozzles of the printhead, comprising the steps of:

connecting a priming device to a source of gas under pressure which is associated to an ink delivery system of the printing apparatus for delivering ink to an ink chamber of a printhead;

selectively positioning a coupling member of the priming device in a priming position sealingly engaging a vent hole of a variable volume air chamber of a printhead to be primed, and an inactive position disengaged from the vent hole, whereby, in the priming position, the coupling member provides fluid communication between the source of gas under pressure and the air chamber of the printhead; and causing gas under pressure to flow from said source of gas under pressure to the air chamber of said printhead which can expand inside the ink chamber, in order to cause a flow of ink through the nozzles.

19. A method as claimed in claim 18, wherein the priming device comprises at least two coupling members arranged on a common support, and the step of selectively positioning the coupling member comprises selectively position the common support and the coupling members in the priming position in which at least one coupling member engages a vent hole of an air chamber of a printhead, and the inactive position in which the coupling members are disengaged from the vent holes.

20. A method as claimed in claim 18, further comprising the step of positioning at least one printhead to be primed in a service area of the apparatus, before said step of sealingly engaging the coupling member to the vent hole of the air chamber.

* * * * *